United States Patent [19]

Tepley et al.

[11] Patent Number: 4,850,053

[45] Date of Patent: Jul. 25, 1989

[54] GLOVE

[75] Inventors: George L. Tepley; George T. Tepley, both of Chattanooga, Tenn.

[73] Assignee: TGC Corporation, Inc., Chattanooga, Tenn.

[21] Appl. No.: 208,532

[22] Filed: Jun. 20, 1988

Related U.S. Application Data

[63] Continuation-in-part of Ser. No. 66,729, Jun. 26, 1987, Pat. No. 4,751,750.

[51] Int. Cl.[4] ..... A41D 19/00

[52] U.S. Cl. ..... 2/161 R; 2/169; 2/159

[58] Field of Search ..... 2/159, 161 A, 161 R, 2/169, 162

[56] References Cited

U.S. PATENT DOCUMENTS

| | | | |
|---|---|---|---|
| 859,559 | 7/1907 | Hoegreen | 2/169 |
| 1,875,441 | 9/1932 | Gillian | 2/169 |
| 2,074,893 | 3/1937 | Dunn | 2/169 |
| 2,168,819 | 8/1939 | Dunn | 2/169 |
| 2,427,170 | 9/1947 | Wells | 2/169 X |
| 2,596,349 | 5/1952 | Thurlow et al. | 2/159 X |
| 2,785,412 | 3/1957 | Zelenka | 2/169 |
| 3,151,334 | 10/1964 | Haupt et al. | 2/169 |
| 3,251,067 | 5/1966 | Shmikler | 2/169 |
| 3,600,715 | 8/1971 | Perrella | 2/162 |
| 3,931,647 | 1/1976 | Dien | 2/161 A |

*Primary Examiner*—Werner H. Schroeder
*Assistant Examiner*—Sara M. Current
*Attorney, Agent, or Firm*—Berman, Aisenberg & Platt

[57] ABSTRACT

A glove comprising a palm piece including a thumb portion, a first finger portion and a fourth finger portion, and a straight linear cut connecting the base of the first finger portion and the fourth finger portion at an angle of between about 13 and 19 degrees to a line parallel to a longitudinal axis of the thumb portion, a back thumb piece, a back piece including first, second, third, and fourth back finger portions, and second and third finger pieces are attached together to provide a glove particularly conformed to the shape of the working hand, the hand in action, the hand as it is naturally meant to be used.

15 Claims, 3 Drawing Sheets

FIG. 1
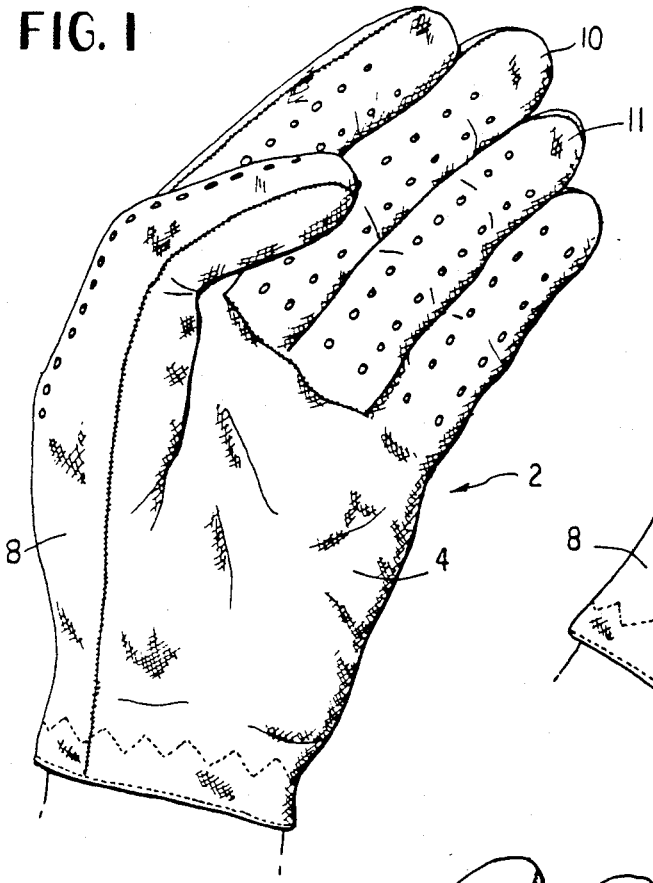
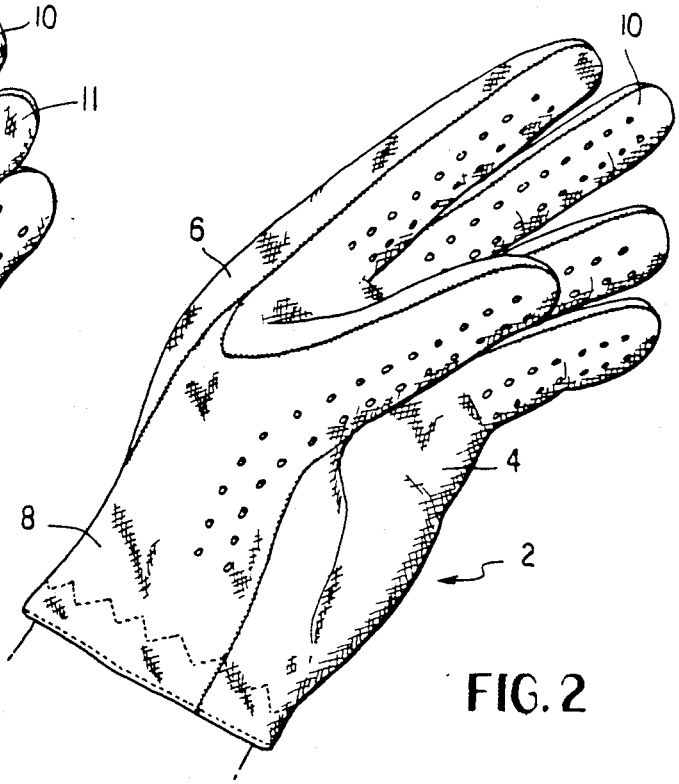
FIG. 2
FIG. 3
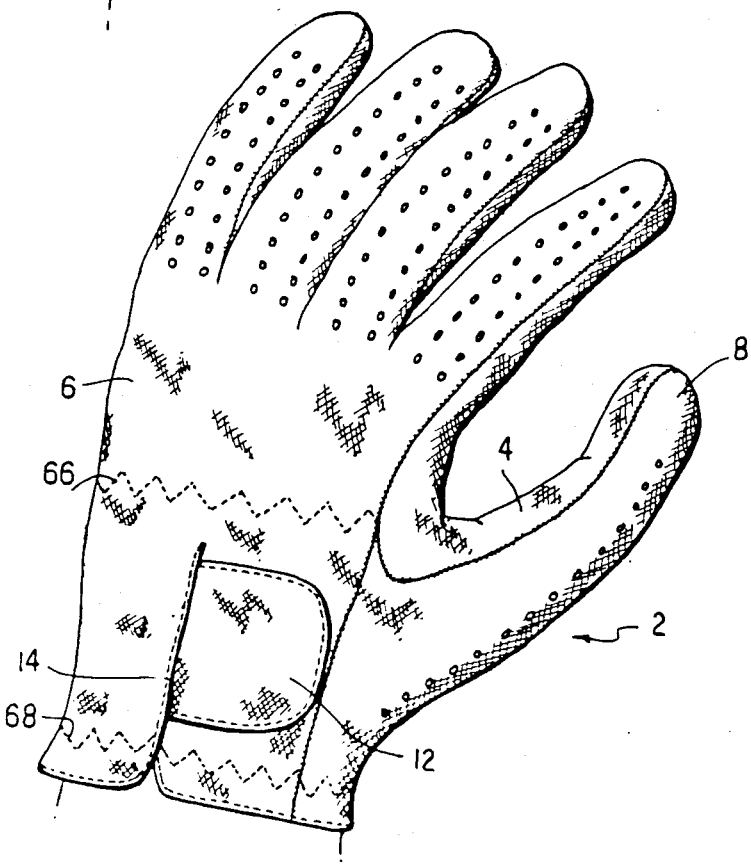

FIG. 4
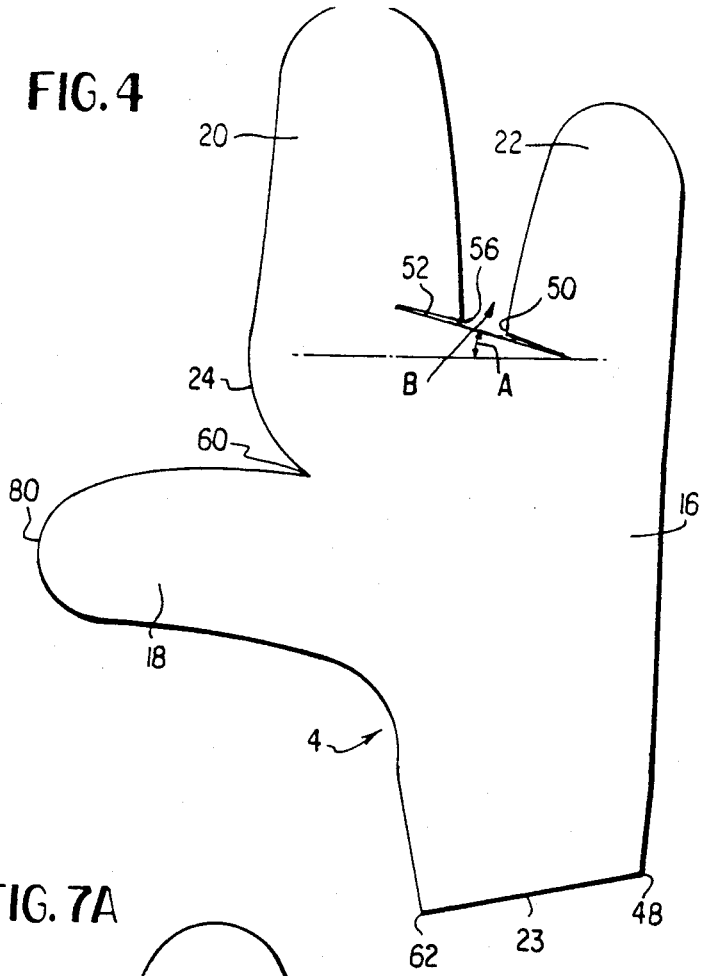
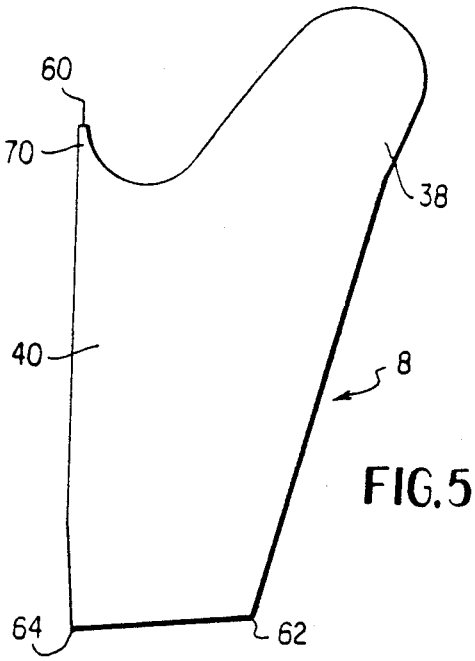
FIG. 5
FIG. 7A
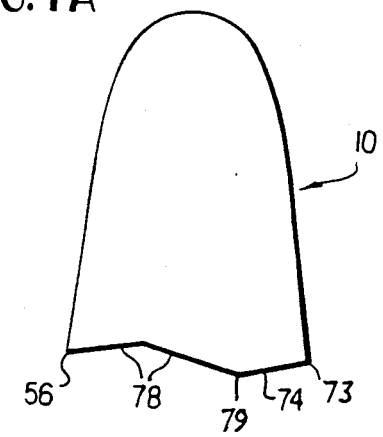
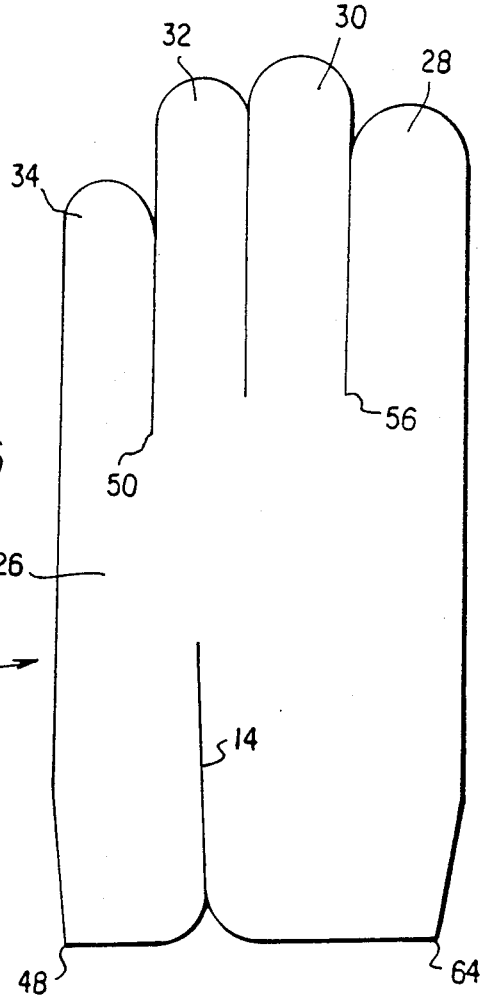
FIG. 6
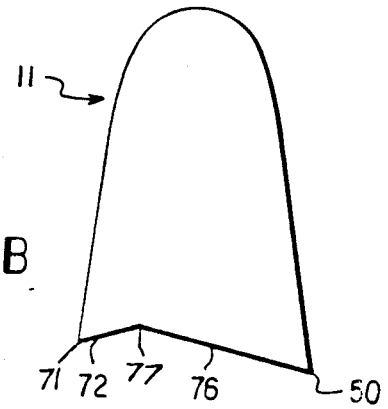
FIG. 7B

GLOVE

This application is a continuation-in-part of Ser. No. 066,729, filed June 26, 1987, which is incorporated herein by reference, in its entirety.

FIELD OF THE INVENTION

The invention relates to gloves, particularly gloves designed for the working hand.

BACKGROUND OF THE INVENTION

It is important to have a glove which conforms to the natural configuration of the hand at work and does not bind or constrict the hand and which lends itself to the natural movement of the hand but is sufficiently tight fitting that excess folds of leather do not impede the grip of the working hand, or provide areas of excessive wear.

Known gloves have a large number of seams which create unnecessary tension in a well-fitting glove.

Different designs of gloves are well known in the art. Raymond, U.S. Pat. No. 905,365, shows a gunn-cut glove having a palm piece including a thumb, first and fourth fingers, in which the portions for the first and fourth fingers are separated by a V-shaped cut and the front portions of the second finger and third finger are separate pieces. The Dunn patent, U.S. Pat. No. 2,074,893, shows another gunn-cut glove having a palm piece including a thumb portion and a portion for the first and fourth fingers. The first and fourth fingers are separated by an angle cut, the front portions of the second and third fingers are in one piece. The thumb portion is cut extending downwards in the pattern piece, which is economical of fabric, but causes the thumb to rest awkwardly against the first finger with a fold of fabric therebetween.

The glove of the Jones patent, U.S. Pat. No. 1,922,095, shows another gunn-cut glove in which the angle between the first and fourth fingers is v-shaped and the thumb portion is cut at an angle which causes the fabric to fold between the thumb and palm of the glove. The glove of the Spivak patent, U.S. Pat. No. 1,179,572 is a gunn-cut glove in which the front and back portions of the glove are cut in one piece, greatly constraining hand movement. Haupt et al., U.S. Pat. No. 3,151,334, shows another gunn-cut glove in which the thumb piece has many seams, causing binding and discomfort to the wearer. The Lindfelt patent, U.S. Pat. No. 1,815,412, shows a handball glove in which the back of the glove is cut with a U-shaped opening, having edges of the opening buckled together.

The patent to Ertl, U.S. Pat. No. 4,559,646, describes a work glove having a padded fabric lining. The thumb portion is cut with a downward orientation as in the glove of Dunn. The patent to Connelly, U.S. Pat. No. 4,245,357, shows another glove having a thumb piece with a downward orientation. The glove is cut on a gunn pattern having curved seams at the base of the first and fourth fingers, and likewise having curved edges seamed therewith on the second and third fingers.

Other patents generally directed to gloves of this type include Shmikler, U.S. Pat. No. 3,251,067; Zelenka, U.S. Pat. No. 2,785,412; Thurlow, U.S. Pat. No. 2,596,349; Wells, U.S. Pat. No. 2,427,170; Dunn, U.S. Pat. No. 2,168,819; Gillian, U.S. Pat. No. 1,875,414 and King, U.S. Pat. No. 1,525,999.

SUMMARY OF THE INVENTION

The glove of the invention is a particularly well-fitting working-hand glove which conforms closely to the natural shape of the hand in action, allowing the hand to be comfortably moved, without the restraint and tension found in the constricting designs of the past, and greatly reduces binding and interference from excess folds of leather. The glove fits closely, is ventilated for comfort, and provides good wear characteristics due to the designed elimination of tension when covering the hand at work - whether such effort is expended on the sports field, golf course, behind the wheel of a car, the factory floor, or any other use.

It is an object of the invention to provide an improved glove for a working hand.

BRIEF DESCRIPTION OF THE DRAWINGS

FIG. 1 is a front elevational view of the improved glove of the invention.

FIG. 2 is a side elevational view of the glove of FIG. 1.

FIG. 3 is a back elevational view of the glove of FIG. 1.

FIG. 4 is a plan view of a palm piece for a left glove of the invention.

FIG. 5 is a plan view of a back thumb piece of a left glove of the invention.

FIG. 6 is a plan view of a back piece of a left glove of the invention.

FIG. 7A is a plan view of a piece for the second finger of a left glove of the invention.

FIG. 7B is a plan view of a piece for the third finger of a left glove of the invention.

DETAILED DESCRIPTION OF THE INVENTION

Figure 8:
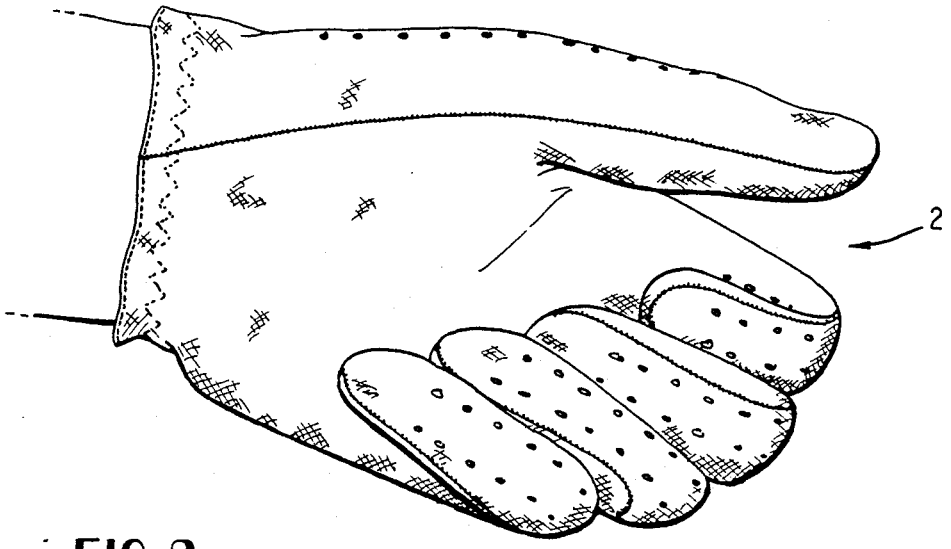
FIG. 8 is a front elevational view of a glove of the invention worn in the working hand position.
Figure 9:
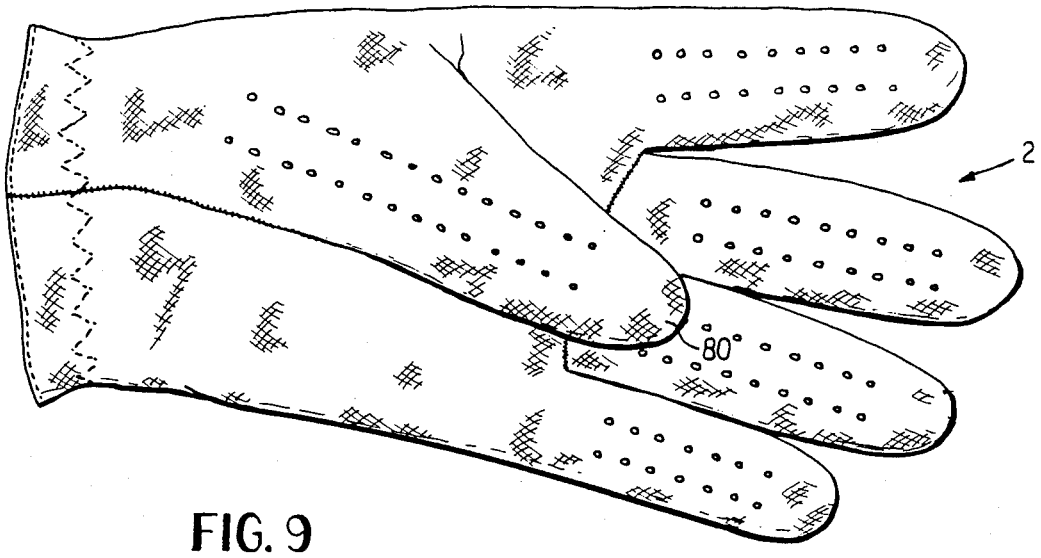
FIG. 9 is a front plan view of a glove.

It is important to have a glove which conforms to the natural configuration of the hand at work and does not bind or constrict the hand and which lends itself to the natural movement of the hand but is sufficiently tight fitting that excess folds of leather do not impede the grip of the working hand.

The glove of the invention may be used whenever gloves are worn, and is particularly useful for wearing when playing sports, such as golf, handball or tennis, or for driving a vehicle. The glove fits the working hand closely and follows the natural contour of the hand, eliminating binding and excess folds of material found in gloves which do not conform, and are not intended to conform, to the shape of the working hand.

The glove is exceptionally comfortable to wear since the shape of the hand is followed. Moreover, the glove has few seams, compared to a traditional glove, further enhancing comfort and eliminating tension.

A glove of the invention includes a palm piece with a thumb portion having a longitudinal axis extending at an angle to a lower edge of the glove, a first finger portion and a fourth finger portion, and a straight linear cut connecting the base of the first finger portion and the base of the fourth finger portion at an angle between about 10 to 22 degrees, and preferably between about 13 to 19 degrees, to a line parallel to the longitudinal axis of the thumb portion. A back thumb piece, a back piece including first, second, third, and fourth back finger portions, a front second finger portion and a front third finger portion are attached together and to the palm piece to provide a glove particularly conformed to the shape of the hand, and particularly suitable for sports or other uses.

With reference to FIGS. 1 to 9 in which like numerals represent like parts, glove 2 is exemplified as a golf glove, but is equally suitable for general wear, or for playing handball, tennis, or other sports. The glove is illustrated as a glove for a left hand; a right hand glove is generally the mirror-image of a left hand glove. Glove 2 is made from five pieces, a palm piece 4, a back piece 6, a back thumb piece 8, a second finger piece 10 and a third finger piece 11. A tab 12 may optionally join two sides of slit 14 in back piece 6. The seams of glove 2 do not interfere with the movement of the hand and do not cause binding. In a traditionally cut glove, the thumb piece has a seam around the base of the thumb which causes binding when the thumb moves, and a traditionally cut glove generally also has excess material in the palm area.

According to the glove of the invention, back thumb piece 8 is seamed up the front side of the glove, over the top of the thumb and down the other side edge of the thumb to meet the vertical side of back piece 6 about halfway up to the back of the hand. Curved portion 70 prevents tension at the join by absorbing any stress. There are no front seams to the glove in the thumb region. The back piece, comprising a back portion and four finger portions, has a seam down the outside edges of the first finger and fourth finger joining the back piece to the palm and back thumb pieces. The back piece is tapered toward its lower edge to provide a snug, comfortable fit. The palm piece comprises front sections of the thumb, first finger and fourth finger. The second and third finger pieces are attached to each other and to the back piece around the back outside edge portions of these fingers, and each finger piece is attached to the palm piece at the base of these two fingers respectively.

FIG. 4 shows palm piece 4 in detail. Palm piece 4 includes first finger portion 20 and fourth finger portion 22. Palm piece 4 further include thumb portion 18 cut with its longitudinal axis extending substantially horizontally from palm portion 16, and substantially perpendicularly to the longitudinal axis of finger portions 20 and 22. Lower edge portion 23 is preferably angled to the longitudinal axis of the thumb.

FIG. 5 shows back thumb piece 8 which has a thumb portion 38 and a back portion 40. FIG. 6 shows back piece 6 having a back portion 26, a first finger portion 28, a second finger portion 30, a third finger portion 32 and a fourth finger portion 34. The outer edges of the back piece are tapered inwardly toward the lower edge to provide a close fit. FIG. 7A shows second finger piece 10 and FIG. 7B shows third finger piece 11.

The glove pieces are attached together, preferably by stitching, seaming palm piece 4 to back piece 6 along the side of the fourth finger from lower corner 48 of the glove up the outside edge of the glove, and along the side, top and inside back edge of the fourth finger to corner 50. Second finger piece 10 and third finger piece 11 are joined together by seaming portions 72 and 74 together from points 71 and 73 to points 77 and 79. At corner 50, third finger piece 11 is joined to palm piece 4 and stitched along the length of cut 52 and edge 76 to point 77. The seam continues by joining second finger piece 10 to palm piece 4 along cut 52 from point 79 on piece 10 to corner 56. Corner 56 is at the base of first finger 28 of back piece 6.

Palm piece 4 and back piece 6 are attached together from corner 56 up the edge of first finger portion 28, over the top of the first finger, and down edge 58 of first finger portion 28 to corner 60 on palm piece 4. At corner 60, also shown on FIG. 5, back thumb piece 8 is attached to back piece 6 and palm piece 4, and a seam follows the contour of the thumb attaching palm piece 4 to back thumb piece 8, the stitching continuing to the lower edge of the glove at corner 62. Back piece 6 and back thumb piece 8 are attached together over the remaining distance to the lower edge corner 64 of back piece 6 of the glove.

A particular feature of the glove of the invention is straight linear cut 52, positioned at an angle A, shown in FIG. 4, of about 10 to 22 degrees, preferably about 13 to 19 degrees, to a line parallel to the longitudinal axis of the thumb portion of piece 4. Angle A is most preferably about 15 to 17 degrees. The size of angle A depends on the size of hand. In general, a larger size of glove requires a smaller angle A, and a smaller size of glove requires a larger angle A. The exact cut of the glove, particularly the measure of angle A, facilitates the close fit of the glove to conform with the working hand.

Proper selection of angle A reduces tension in the glove by allowing it to conform to the contour of the working hand, closely following the natural form of the hand in action, enabling increased comfort in wear. An angle A preferably of about 13 to 19 degrees, allows the hand to close down naturally without restricting or binding the fingers, and without needing excess leather in the palm and finger area for comfort, thus providing a snug fit throughout the one-piece palm/front thumb portion 4. The cut of the glove avoids tension in the palm or in the back of the hand. Seams are placed on the back portion of the glove, adjacent the back of the hand only and constrict hand movement less than seams on the front of the glove (as conventionally used). The glove of the invention also avoids pressure on the fingertips, commonly found in a conventional glove in which the finger pieces are separate and have two seams, at the front edge and back edge of each finger.

Moreover, in existing glove design, the front thumb portion is cut to point straight upwards toward the first finger. In the glove of the invention, the thumb is cut with its longitudinal axis extending substantially horizontally from palm piece 4 and substantially perpendicularly to the longitudinal axis of the first finger portion 4. When the hand is flexed, for example, when gripping a golf club, the thumb moves naturally towards the third finger, which is the path of least resistance thus providing mobility through the palm and facilitating natural closing of the working hand. FIG. 8 shows a glove 2 in the working hand position, as if about to grip an article, such as a golf club or steering wheel of a vehicle. Tip 80 of thumb portion 18 of palm piece 4 naturally identifies with the space B between first finger portion 20 and fourth finger portion 22, shown in FIG. 4, and shown on a glove 2 in FIG. 9 which clearly illustrates the identification of the thumb of the glove with the third finger, to follow the natural closing motion of a hand.

The glove may further include a fastening, such as tab 12 shown in FIG. 3, extending across slit 14. The fastening may be secured in any conventional manner, such as by using an adhesive hook and loop fastening, such as VELCRO (VELCRO is a trademark of Velcro USA, Inc.), or by using snap fasteners, or the sides of the slit may be joined by a zipper or by other means known to one skilled in the art.

The back of the glove of the invention may optionally be provided with at least one row of elastic 66 applied by stitching, or other means, as shown in FIG. 3. A row of elastic 68 may also be applied around the bottom edge of the glove, as shown in FIGS. 1 to 3 providing a snug fit around the wrist. Perforations for ventilation, for example, in back piece 4 and/or in thumb piece 8 may optionally be used, as illustrated in FIGS. 1 to 3, as known to one skilled in the art.

The glove is suitably made of sheepskin, kidskin or other soft leather materials. A preferred material is cabretta (a type of sheepskin). Woven or nonwoven fabrics or other suitable material may also be used. The glove may be used for golf, tennis, baseball, handball, driving, or for general purposes, such as for a dress glove.

While the invention has been described above with respect to certain embodiments thereof, it will be appreciated that variations and modifications may be made without departing from the spirit and scope of the invention.

What is claimed is:

1. A glove comprising:

a palm piece including a first finger portion, a fourth finger portion, a thumb portion, and a straight linear cut connecting the base of the first finger portion and the base of the fourth finger portion, said straight linear cut extending at an angle of about 10 to 22 degrees to a line parallel to a longitudinal axis of the thumb portion, wherein the longitudinal axis of the thumb portion extends substantially perpendicularly to the longitudinal axis of the first finger portion.

2. A glove of claim 1 further comprising a back thumb piece attached to the thumb portion of the palm piece.

3. A glove of claim 2 further comprising a back piece including first, second, third and fourth finger portions, said back piece attached at its sides to the palm piece and the back thumb piece.

4. A glove of claim 3 further comprising second and third finger pieces attached to the palm piece and the back piece.

5. A glove of claim 4 wherein the second and third finger pieces are joined together and joined along the length of the straight linear cut from an inner corner of the base of the first finger to an inner corner of the base of the fourth finger.

6. A glove of claim 1 wherein the straight linear cut extends at an angle of about 13 to 19 degrees to a line parallel to a longitudinal axis of the thumb, following the natural slope of the working hand.

7. A glove of claim 6 wherein the straight linear cut extends at an angle of about 15 to 17 degrees.

8. A glove of claim 3 further comprising a slit in said back piece extending from about the middle of the lower edge of the back piece toward the fingers in a direction substantially perpendicular to said lower edge.

9. A glove of claim 8 further comprising a means for fastening across the slit.

10. A glove of claim 9 wherein the means for a fastening comprises a tab attached to the glove on one side of the slit and securable to the glove on the other side of the slit.

11. A glove of claim 3 wherein the back piece further comprises stretchable means for providing a close fit of the glove to the hand.

12. A glove of claim 11 wherein the stretchable means comprises at least one row of elastic.

13. A glove of claim 1 wherein the glove further comprises stretchable means extending adjacent the lower edge of the glove for providing a close fit of the glove to the hand.

14. A glove of claim 13 wherein the stretchable means comprises elastic.

15. A glove comprising:

a palm piece including a first finger portion, a fourth finger portion, and a thumb portion having a longitudinal axis which extends substantially perpendicular to the longitudinal axis of the first finger portion, a back thumb piece attached to the thumb portion of the palm piece, a back piece including first, second, third and fourth finger portions, said back piece attached to the back thumb piece and the palm piece, and second and third finger pieces attached to each other, to the back piece, and to the palm piece along the length of a slit between the first and fourth finger portions of the palm piece;

wherein the base of the first finger portion and the base of the fourth finger portion of said palm piece are connected by a straight line cut angled at between 13 and 19 degrees to a line parallel to the longitudinal axis of the thumb, said straight line cut extending across the base of the second and third fingers, said second and third finger pieces being stitched to edges of said straight line cut.

* * * * *